US010914152B2

(12) United States Patent
Shen

(10) Patent No.: US 10,914,152 B2
(45) Date of Patent: Feb. 9, 2021

(54) OIL-DISPLACING SYSTEM AND METHOD USING TRANSIENT ELECTROMAGNETIC GENERATOR

(71) Applicant: Beijing Huahui Shengshi Energy Technology Co., Ltd., Beijing (CN)

(72) Inventor: Yongjin Shen, Beijing (CN)

(73) Assignee: BEIJING HUAHUI SHENGSHI ENERGY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 16/681,150

(22) Filed: Nov. 12, 2019

(65) Prior Publication Data

US 2020/0408076 A1 Dec. 31, 2020

(30) Foreign Application Priority Data

Jun. 27, 2019 (CN) ..... 2019 1 0564937

(51) Int. Cl.
*E21B 43/24* (2006.01)

(52) U.S. Cl.
CPC ..... *E21B 43/2401* (2013.01)

(58) Field of Classification Search
None
See application file for complete search history.

(56) References Cited

U.S. PATENT DOCUMENTS 5,065,819 A * 11/1991 Kasevich ..... E21B 36/04 166/248
2015/0096744 A1* 4/2015 Signorelli ..... E21B 41/0085 166/244.1
2015/0167440 A1* 6/2015 Kasevich ..... E21B 33/124 166/52
2015/0346376 A1* 12/2015 Fouda ..... E21B 47/092 324/338
2016/0024907 A1* 1/2016 Krivosheev ..... E21B 28/00 166/253.1

* cited by examiner

*Primary Examiner* — Andrew Sue-Ako
(74) *Attorney, Agent, or Firm* — Tutunjian & Bitetto, P.C.

(57) ABSTRACT

The present invention discloses an oil-displacing system and method. The system includes a power supply, a control switch, a controller and a transient electromagnetic generator. The power supply is connected to the transient electromagnetic generator, the control switch is disposed in a connection path between the power supply and the transient electromagnetic generator, and a control end of the control switch is connected to the controller. The controller is configured for controlling the closing and opening of the control switch, thereby controlling the connection and closing of the connection path between the power supply and the transient electromagnetic generator. The transient electromagnetic generator is disposed in an oil well casing at a position in an oil formation, for generating a transient electromagnetic field according to the connection and closing of the connection path between the power supply and the transient electromagnetic generator. The oil-displacing system and method provided by the present invention can dredge a pore throat and improve recovery efficiency.

5 Claims, 5 Drawing Sheets

OIL-DISPLACING SYSTEM AND METHOD USING TRANSIENT ELECTROMAGNETIC GENERATOR

REFERENCE TO RELATED APPLICATIONS

This application claims priority to Chinese application number 201910564937.4, filed Jun. 27, 2019, with a title of OIL-DISPLACING SYSTEM AND METHOD. The above-mentioned patent application is incorporated herein by reference in its entirety.

TECHNICAL FIELD

The present invention relates to the technical field of through-casing oil recovery for oil exploitation, and in more particularly, to an oil-displacing system and method.

BACKGROUND

Existing physical oil recovery methods mostly employ a steady-state electric field force, a steady-state magnetic field force, and an ultrasonic vibration. Electric field force and magnetic field force methods apply a high pressure or a strong current to an oil formation to heat the oil formation or continuously give the oil formation an electric force or a magnetic force; an ultrasonic vibration method applies a continuous sinusoidal excitation vibration to the formation to cause mechanical displacement, thereby reducing a surface force on a pore throat inside the porous formation, and improving the permeability of the formation. These oil recovery techniques have two main problems in application. First, oil recovery is carried out in a cased well; a casing is not only an electrically conductive medium, but also a magnetically conductive medium and a medium with high acoustic impedance; a current emitted in the well flows along the casing and cannot enter the oil formation, but passes through a mudstone formation or a water formation with high conductivity (cation exchange conduction); therefore, the current in the oil formation is small, and the effect is small too. Second, the acoustic impedance of the casing is different from the acoustic impedance of liquid in the well; when ultrasound is emitted in the cased well, most of the energy is reflected by the inner wall of the casing and cannot enter the formation; therefore, effective vibration energy enters the formation less and the effect is limited.

SUMMARY

An objective of the present invention is to provide an oil-displacing system and method, to dredge a pore throat and improve recovery efficiency.

To achieve the above purpose, the present invention provides the following technical solutions.

An oil-displacing system includes a power supply, a control switch, a controller and a transient electromagnetic generator, where the power supply is connected to the transient electromagnetic generator; the control switch is disposed in a connection path between the power supply and the transient electromagnetic generator; a control end of the control switch is connected to the controller; the controller is configured for controlling the closing and opening of the control switch, thereby controlling the connection and closing of the connection path between the power supply and the transient electromagnetic generator; the transient electromagnetic generator is disposed in an oil well casing at a position in an oil formation, for generating a transient electromagnetic field according to the connection and closing of the connection path between the power supply and the transient electromagnetic generator.

Optionally, the power of the power supply is greater than 20 kW, and the power supply is disposed on the ground.

Optionally, the controller includes a timing unit and a control unit;

the timing unit is connected to the control unit; the control unit is connected to the control switch; the control unit is excited by the timing unit to control the closing and opening of the control switch in a timely manner.

Optionally, the controller includes a first switch, a second switch, a third switch, and a fourth switch;

a first end of the first switch is connected to a positive pole of the power supply, and a second end of the first switch is connected to a first end of the transient electromagnetic generator;

a first end of the second switch is connected to a second end of the transient electromagnetic generator, and a second end of the second switch is connected to a negative pole of the power supply;

a first end of the third switch is connected to the positive pole of the power supply, and a second end of the third switch is connected to the second end of the transient electromagnetic generator;

a first end of the fourth switch is connected to the first end of the transient electromagnetic generator, and a second end of the fourth switch is connected to the negative pole of the power supply;

a control end of the first switch, a control end of the second switch, a control end of the third switch, and a control end of the fourth switch are all connected to the control unit, and the control unit is configured for controlling the closing and opening of the first switch, the second switch, the third switch, and the fourth switch; the first switch and the second switch have a synchronized state, and the third switch and the fourth switch have a synchronized state; when the first switch and the second switch are closed, the third switch and the fourth switch are open; when the third switch and the fourth switch are closed, the first switch and the second switch are open.

Optionally, the timing unit specifically includes:

a first timing subunit, for generating a first excitation signal, the control unit controlling a closing time of the first switch and the second switch in a timely manner according to the first excitation signal; and a second timing subunit, for generating a second excitation signal, the control unit controlling a closing time of the third switch and the fourth switch in a timely manner according to the second excitation signal.

Optionally, the transient electromagnetic generator includes a coil and a capacitor; the coil and the capacitor are connected, and are both disposed at a central axis of the oil well casing; a central axis of the coil coincides with the central axis of the oil well casing; an electrode plate of the capacitor is parallel to the central axis of the oil well casing.

Optionally, the capacitor is a ceramic capacitor.

An oil-displacing method includes:

turning on a power supply;

determining whether a turn-on time of the power supply reaches a first set time, to obtain a first determination result;

turning off the power supply, a transient electromagnetic generator generating a first transient electromagnetic field, when the first determination result indicates that the turn-on time of the power supply reaches the first set time;

determining whether a turn-off time of the power supply reaches a second set time, to obtain a second determination result; and returning to the step of turning on the power supply, the transient electromagnetic generator generating a second transient electromagnetic field, the direction of the second transient electromagnetic field being opposite to the direction of the first transient electromagnetic field, when the second determination result indicates that the turn-off time of the power supply reaches the second set time.

Optionally, the oil-displacing method further includes the following steps after turning on a power supply:

determining whether a closing time of a first switch reaches a third set time, to obtain a third determination result, the third set time being less than the first set time;

opening the first switch and a second switch, and closing a third switch and a fourth switch, when the third determination result indicates that the closing time of the first switch reaches the third set time;

determining whether a closing time of the third switch reaches a fourth set time, to obtain a fourth determination result, the fourth set time being less than the second set time; and opening the third switch and the fourth switch, and closing the first switch and the second switch, when the fourth determination result indicates that the closing time of the third switch reaches the fourth set time.

According to specific embodiments provided in the present invention, the present invention discloses the following technical effects. The present invention provides an oil-displacing system, where a controller controls the working state of a control switch, thereby controlling alternate connection and disconnection of a connection path between a power supply and a transient electromagnetic generator; the transient electromagnetic generator generates a transient electromagnetic field according to the alternate connection and disconnection of the connection circuit; the transient electromagnetic field generates high-power electromagnetic energy, which passes through an oil well casing to enter a formation, thereby effectively overcoming the shielding effect of the casing on the electromagnetic energy. In addition, a charged ion of liquid in the porous formation is moved in a pore throat under the alternating action of strong electric and magnetic forces to increase fluidity, and the rapid flow of the ion forms an electric current, which is converted into Joule heat inside the pore throat to destroy the binding of the surface tension of a pore to the oil formation and increase recovery efficiency.

BRIEF DESCRIPTION OF THE DRAWINGS

To describe the technical solutions in the embodiments of the present invention or in the prior art more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide an oil-displacing system and method, to dredge a pore throat and improve recovery efficiency. To reach the foregoing objective, features, and advantages of the present invention clearer and more comprehensible, the present invention is further described in detail below with reference to the accompanying drawings and specific embodiments.

Figure 1A:
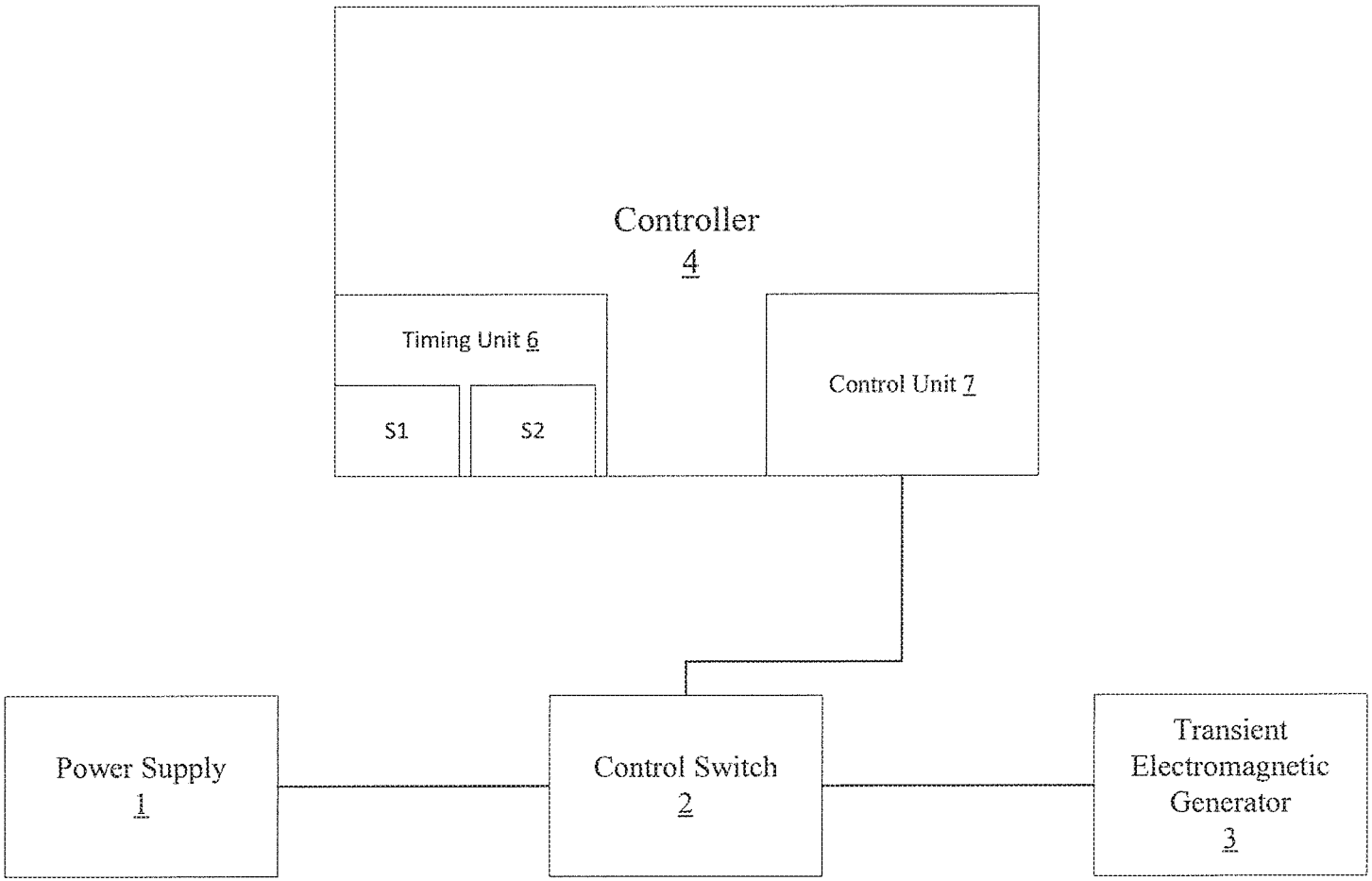
FIG. 1A is a block schematic diagram of an oil-displacing system according to an embodiment of the present invention.

FIG. 1A is a schematic structural diagram of an oil-displacing system according to an embodiment of the present invention. As shown in FIG. 1, the oil-displacing system provided by the present invention includes a power supply 1, a control switch 2, a controller 4 and a transient electromagnetic generator 3. The power supply 1 is connected to the transient electromagnetic generator 3 via the control switch 2 which is disposed in the connection path between the power supply 1 and the transient electromagnetic generator 3. A control end of the control switch 2 is connected to the controller 4. The controller is configured for controlling the closing and opening of the control switch, thereby controlling the connection and closing of the connection path between the power supply 1 and the transient electromagnetic generator 3. The transient electromagnetic generator 3 is disposed in an oil well casing at a position in an oil formation, for generating a transient electromagnetic field according to the connection, and closing of the connection path between the power supply 1 and the transient electromagnetic generator 3.

In order to ensure that the generated transient electromagnetic field is capable of generating high-power transient electromagnetic energy, the power of the power supply 1 is preferably greater than 20 kW, and for convenience of disposing the power supply, the power supply 1 is disposed on the ground.

In order to be capable of periodically controlling the connection and disconnection of the conduction path between the power supply 1 and the transient electromagnetic generator 3, the controller 4 includes a timing unit 6 and a control unit 7. The timing unit 6 is connected to the control unit 7 and the control unit is connected to the control switch 2. The control unit 7 is excited by the timing unit 6 to control the closing and opening of the control switch 2 in a timely manner.

Moreover, in order to ensure the control of the control switch 2 by the control unit 7 in the controller 4, the control switch 2 in the present application is preferably a switch of insulated gate bipolar transistor.

Figure 1B:
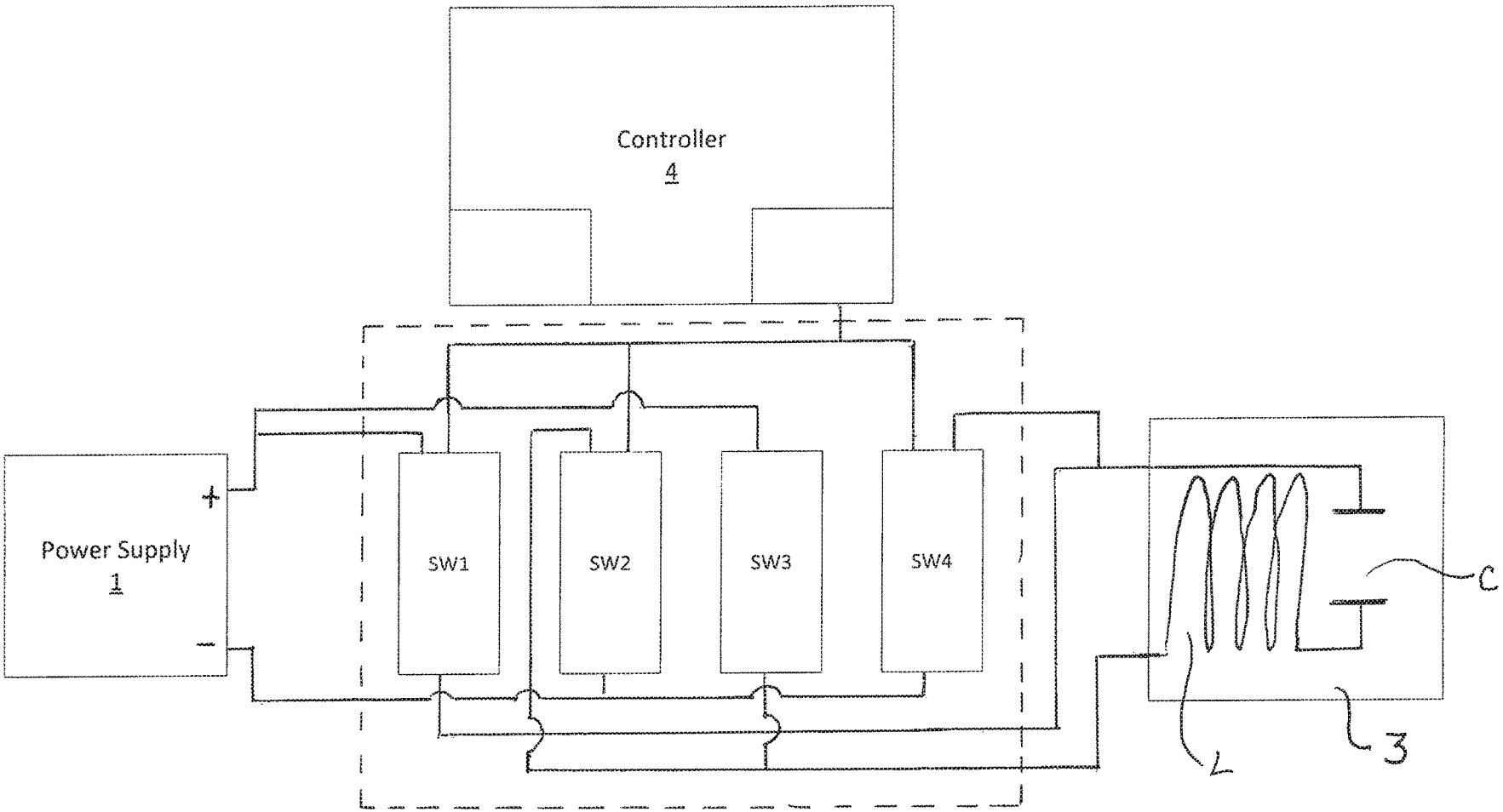
FIG. 1B is a block schematic diagram of FIG. 1A showing more detail within the control switch according to an embodiment of the invention.

In order to enhance the generated transient electromagnetic field, the control switch 2 includes a first switch SW1, a second switch SW2, a third switch SW3, and a fourth switch SW4 (See FIG. 1B).

A first end of the first switch SW1 is connected to a positive pole of the power supply 1, and a second end of the first switch SW1 is connected to a first input of the transient electromagnetic generator 3.

A first end of the second switch SW2 is connected to a second input of the transient electromagnetic generator 3, and a second end of the second switch SW2 is connected to a negative pole of the power supply 1.

A first end of the third switch SW3 is connected to the positive pole of the power supply 1, and a second end of the third switch SW3 is connected to the second input of the transient electromagnetic generator 3.

A first end of the fourth switch SW4 is connected to the first input of the transient electromagnetic generator 3, and a second end of the fourth switch SW4 is connected to the negative pole of the power supply 1.

A control end of the first switch SW1, a control end of the second switch SW2, a control end of the third switch SW3, and a control end of the fourth switch SW4 are all connected to the control unit 7, and the control unit is configured for controlling the closing and opening of the first switch SW1, the second switch SW2, the third switch SW3, and the fourth switch SW4. The first switch SW1 and the second switch SW2 have a synchronized state, and the third switch SW3 and the fourth switch SW4 have a synchronized state. When the first switch SW1 and the second switch SW2 are closed, the third switch SW3 and the fourth switch SW4 are open. When the third switch SW3 and the fourth switch SW4 are closed, the first switch SW1 and the second switch SW2 are open.

In order to stably enhance the generated transient electromagnetic field, when the first switch SW1 and the second switch SW2 are closed, the third switch SW3 and the fourth switch SW4 are opened after a period of delay. When the third switch SW3 and the fourth switch SW4 are closed, the first switch SW1 and the second switch SW2 are opened after a period of delay.

Further, the timing unit 6 specifically includes a first timing subunit S1 and a second timing subunit S2. The first timing subunit S1 is configured for generating a first excitation signal. The control unit 7 controls a closing time of the first switch SW1 and the second switch SW2 in a timely manner in response to the first excitation signal.

The second timing subunit S2 is configured for generating a second excitation signal. The control unit 7 controls a closing time of the third switch SW3 and the fourth switch SW4 in a timely manner in response to the second excitation signal.

In the oil-displacing system provided by the present invention, the transient electromagnetic generator 3 includes a coil L and a capacitor C. The coil and the capacitor are connected and are both disposed at a central axis of the oil well casing. A central axis of the coil coincides with the central axis of the oil well casing; an electrode plate of the capacitor is parallel to the central axis of the oil well casing.

The capacitor and the coil are connected in parallel or in series. When the capacitor and the coil are connected in parallel, the moment when the connection path between the power supply and the transient electromagnetic generator is connected, the voltage of the capacitor cannot jump, and is 0 V. The voltage of the coil is also 0 V. The current of the coil cannot jump, and is 0 A. The voltage of the power supply generates a large current to charge the capacitor, and the voltage of the capacitor rises rapidly, generating a radial transient electric field in a formation. When the voltage of the capacitor rises, the voltage in the coil also rises, and the current of the coil begins to increase, thus generating a magnetic field and a vortex induced electromotive force in the formation, and a strong electric field impact force in a circumferential direction. When the connection path between the power supply 1 and the transient electromagnetic generator 3 is disconnected, the voltage of the capacitor cannot jump, and the current of the coil cannot jump, either at this time, as an external current has been turned off. The internal resistance of the coil is subjected to the voltage of the capacitor. The current of the coil flows toward the capacitor to change the voltage of the capacitor and generate an electric field impact force in a radial direction. The voltage on the coil is changed accordingly, and under the action of the voltage, the current of the coil is changed rapidly, thereby generating an induced electromotive force in the formation and forming an electric field impact force in a circumferential direction. Thus, a conductive ion of liquid in the porous formation flows rapidly to increase fluidity and form a current. The current is converted into Joule heat inside a pore throat to destroy the binding of the surface tension of a pore to the oil formation and increase recovery efficiency.

In the embodiment of the present invention, the capacitor is a ceramic capacitor.

Figure 2:
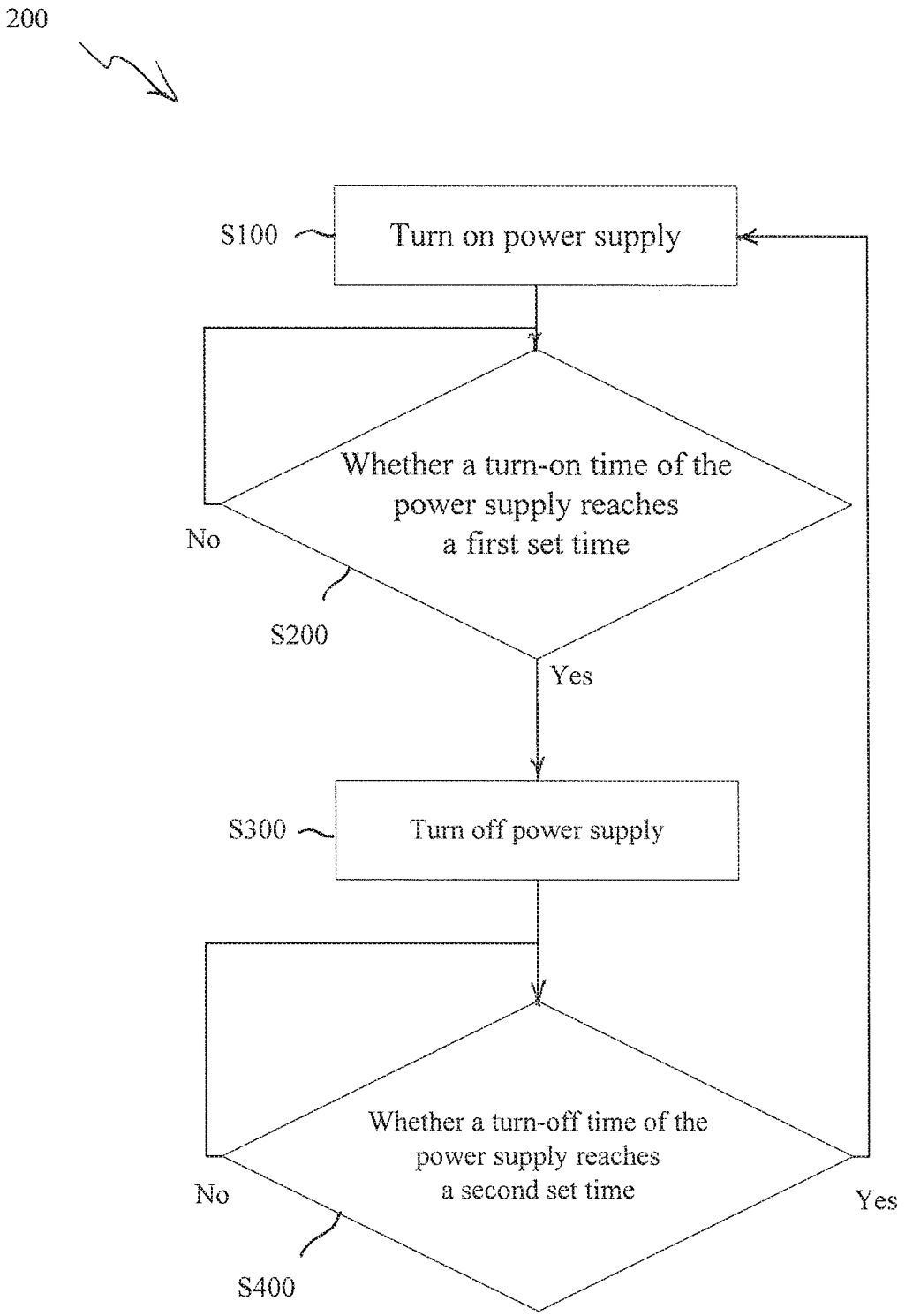
FIG. 2 is a flowchart of an oil-displacing method according to an embodiment of the present invention.

FIG. 2 is a flowchart of an oil-displacing method according to an embodiment of the present invention. As shown in FIG. 2, the oil-displacing method provided by the present invention includes: S100: turn on a power supply; S200: determine whether a turn-on time of the power supply reaches a first set time, to obtain a first determination result; S300: turn off the power supply, the transient electromagnetic generator generates a first transient electromagnetic field, when the first determination result indicates that the turn-on time of the power supply reaches the first set time; and S400: determine whether a turn-off time of the power supply reaches a second set time, to obtain a second determination result.

When the power supply is turned on (S300), the transient electromagnetic generator generates a second transient electromagnetic field. The direction of the second transient electromagnetic field being opposite to the direction of the first transient electromagnetic field. When the second determination at S400 indicates that the turn-off time of the power supply reaches the second set time.

Figure 3A:
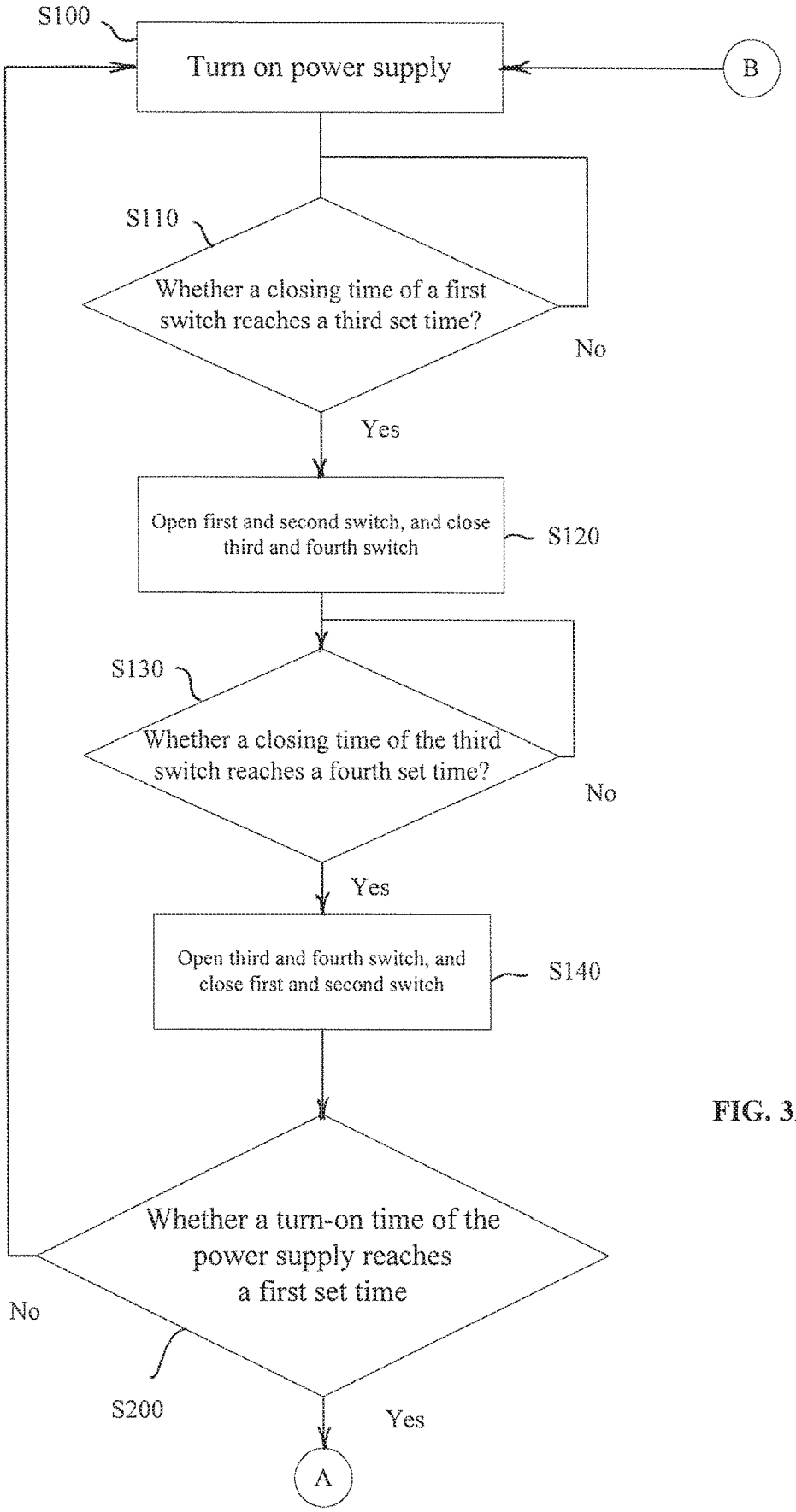
FIGS. 3A and 3B are a flowchart of the oil displacing method according to another embodiment of the invention.
Figure 3B:
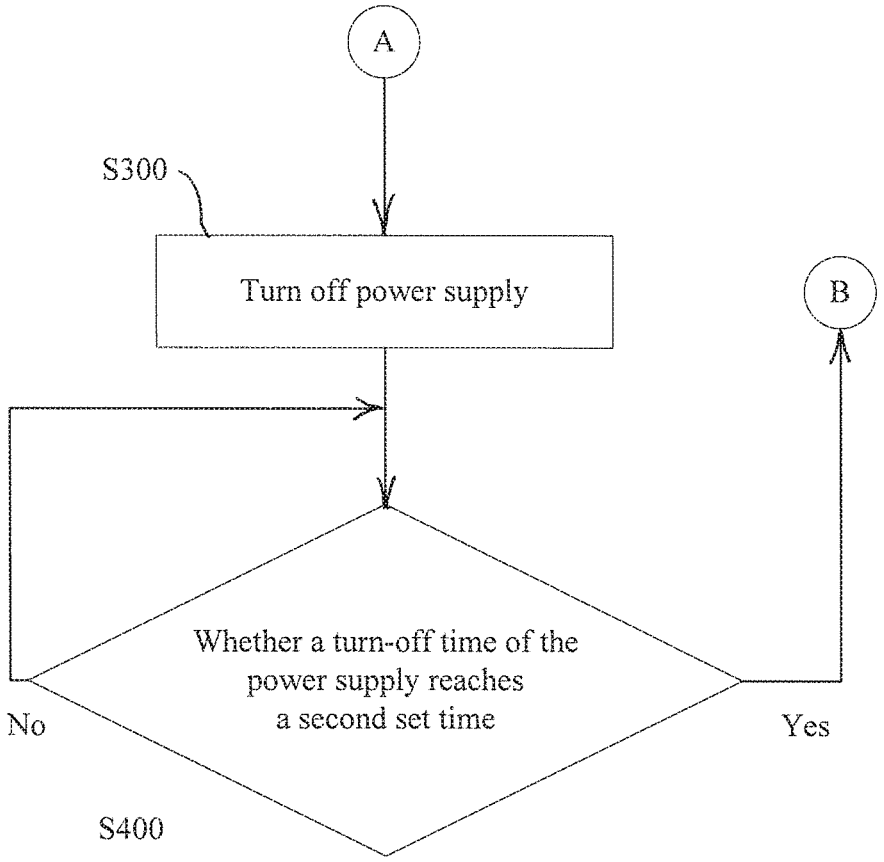

Referring to FIGS. 3A and 3B, the method further includes the following steps after step 100 turning on a power supply:

S110—determine whether a closing time of a first switch reaches a third set time, to obtain a third determination result, the third set time being less than the first set time;

S120 open the first switch and a second switch, and close a third switch and a fourth switch after a period of delay, when the third determination result S110 indicates that the closing time of the first switch reaches the third set time;

S130 determine whether a closing time of the third switch reaches a fourth set time, to obtain a fourth determination result, the fourth set time being less than the second set time; and S140 open the third switch and the fourth switch and close the first switch and the second switch after a period of delay, when the fourth determination result indicates that the closing time of the third switch reaches the fourth set time.

Each embodiment of the present specification is described in a progressive manner, each embodiment focuses on the difference from other embodiments, and the same and similar parts between the embodiments may refer to each other.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the present invention.

What is claimed is:

1. An oil-displacing system, comprising a power supply, a control switch connected to the power supply and having a control input and comprising a first switch, a second switch, a third switch and a fourth switch, each switch being connected to the control input;

a controller connected to the control input of the control switch, the controller having a timing unit and a control unit connected to the timing unit, the control unit being connected to the control input of the control switch such that timed excitation of the control unit by the timing unit controls the closing and opening of the control switch; and a transient electromagnetic generator connected to the control switch and being disposed in an oil well casing at a position in an oil formation for generating a transient electromagnetic field in response to being connected to the power supply via the control switch; the control switch further comprising:

the first switch having a first end connected to a positive pole of the power supply, a second end connected to a first end of the transient electromagnetic generator, and the control input connected to the control unit;

the second switch having a first end connected to a second input of the transient electromagnetic generator, a second end connected to a negative pole of the power supply, and the control input connected to the control unit, the first switch and the second switch have a synchronized state;

the third switch having a first end connected to the positive pole of the power supply, a second end connected to the second input of the transient electromagnetic generator, and the control input connected to the control unit;

the fourth switch connected to the first input of the transient electromagnetic generator, a second end connected to the negative pole of the power supply, and the control input connected to the control unit, the third switch and the fourth switch have a synchronized state;

wherein the control unit is configured to control the closing and opening of the first switch, the second switch, the third switch and the fourth switch, such that when the first switch and the second switch are closed, the third switch and the fourth switch are open, and when the third switch and the fourth switch are closed, the first switch and the second switch are open.

2. The oil-displacing system according to claim 1, wherein the timing unit further comprises:

a first timing subunit generating a first excitation signal, the control unit controlling a closing time of the first switch and the second switch in a timely manner in response to the first excitation signal; and a second timing subunit generating a second excitation signal, the control unit controlling a closing time of the third switch and the fourth switch in a timely manner in response to the second excitation signal.

3. The oil-displacing system according to claim 1, wherein the transient electromagnetic generator comprises a coil and a capacitor connected to the coil, said coil and capacitor being disposed at, and coinciding with a central axis of the oil well casing, wherein an electrode plate of the capacitor is parallel to the central axis of the oil well casing.

4. The oil-displacing system according to claim 3, wherein the capacitor comprises a ceramic capacitor.

5. An oil-displacing method applied to the oil-displacing system according to claim 1, comprising:

turning on the power supply;

determining whether a turn-on time of the power supply reaches a first set time to obtain a first determination result;

turning off the power supply when the first determination result indicates that the turn-on time of the power supply reaches the first set time, the transient electromagnetic generator generating a first transient electromagnetic field having a first direction;

determining whether a turn-off time of the power supply reaches a second set time, to obtain a second determination result; and returning to the step of turning on the power supply when the second determination result indicates that the turn-off time of the power supply reaches the second set time, the transient electromagnetic generator generating a second transient electromagnetic field in response, wherein a second direction of the second transient electromagnetic field is opposite to the first direction of the first transient electromagnetic field.

* * * * *